United States Patent [19]

DiLorenzo

[11] Patent Number: 4,760,855

[45] Date of Patent: Aug. 2, 1988

[54] HAIRDRESSING CAP

[76] Inventor: Antonio DiLorenzo, 21 Bedford St., Methuen, Mass. 01844

[21] Appl. No.: 77,807

[22] Filed: Jul. 27, 1987

[51] Int. Cl.[4] ..... A45D 19/18

[52] U.S. Cl. ..... 132/9

[58] Field of Search ..... 132/9, 7; 2/68, 174

[56] References Cited

U.S. PATENT DOCUMENTS

| | | | |
|---|---|---|---|
| 2,818,074 | 12/1957 | Mach | 132/9 |
| 2,957,480 | 10/1960 | Widoff et al. | 132/9 |
| 3,270,753 | 9/1966 | Cook et al. | 132/9 |
| 3,468,318 | 9/1969 | Cook et al. | 132/9 |
| 3,586,009 | 6/1971 | Sirmons | 132/9 |
| 4,155,369 | 5/1979 | Guinan | 132/9 |
| 4,267,850 | 5/1981 | Barrett | 132/9 |
| 4,357,951 | 11/1982 | Aricco | 132/9 |
| 4,724,852 | 2/1988 | Ramik | 132/9 |

*Primary Examiner*—Robert Peshock

*Assistant Examiner*—James R. Hakomaki

*Attorney, Agent, or Firm*—Edward A. Gordon

[57] ABSTRACT

The present invention discloses a device for selectively treating strands of hair with a treating solution. The device is formed of a fluid impervious flexible sheet material in the shape of a cap to conform to the head of a person in a generally overlying relationship to the hair thereof and having an inner surface and an outer surface. A plurality of air cells are disposed in spaced relationship about the outer surface of the sheet material forming the cap. The air cells are formed of a generally dome-shaped flexible wall member and have a base wall integral with the sheet material. The air cells are puncturable to form perforations permitting strands of hair to be pulled therethrough for treatment with the treating solution. The punctured air cell walls form a pocket seal around the strands of hair thereby preventing the penetration of the treating solution to the scalp and hair not to be treated below the sheet material.

11 Claims, 2 Drawing Sheets

HAIRDRESSING CAP

FIELD OF THE INVENTION

The present invention relates to the dressing and treatment of a person's hair and more particularly to devices for facilitating the selective treatment of portions of hair of the head of a person, such as frosting, bleaching, tipping or selective coloring thereof.

BACKGROUND OF THE INVENTION

Frequently in hair beautification, it is desired to operate on a few individual strands of hair. This may involve what is known as hair tipping, where portions only of the hair are to be bleached or otherwise colored. Obviously, the operator can select and grasp a lock of the hair to be dipped in the bleach or other fluid. However, this is a difficult operation because the liquid used tends to contact the adjacent portions of the hair and not merely the strands selected. As a result, instead of treating a single tress as desired, a spotted or splotched appearance obtains.

In an effort to alleviate this, it was proposed in the past to provide a hair covering having perforations through which the hair strands could be drawn. This was to separate the hair to be treated from the remainder of the hair. While this suggestion possesses certain obvious advantages, nevertheless it is not satisfactory in many respects. This is because the liquid is free to run down the strand of hair, through the aperture in the head covering, and then to spread out beneath. Thus, again a spotted appearance often results rather than the anticipated bleaching or other treating of only a selected lock of hair.

Numerous protector devices have been developed in the past particularly for selectively treating hair while protecting the scalp and other hair not being treated from the treating solutions such as streaking, tipping, frosting, bleaching and coloring solutions. The state of the art is believed to be illustrated in the following U.S. Patents:

| | | |
|---|---|---|
| 3,270,753 | 3,468,318 | 4,165,754 |
| 3,304,945 | 3,586,009 | 4,215,709 |
| 3,390,689 | 4,155,369 | 4,357,951 |

While such prior art devices provide improvement in the areas intended, there still exists a great need for a hairdressing cap which is simple in construction, does not require accessory guard devices, and provides a reliable seal about the strands of hair to be treated and complete protection for the portion of the hair and scalp which are not to be treated.

Accordingly, a principal desirable object of the present invention is to provide a hairdressing device for treating individual portions of the hair.

Another desirable object of the invention is to provide a hairdressing cap used in treating hair that allows strands of hair to be drawn to the outside while preventing the flow of treating solution to the under surface.

A further desirable object of the invention is to provide a hair treating device in the form of a fluid-impervious cap to be punctured when a strand or strands of hair is to be drawn outwardly while providing a seal about the hair to be treated to prevent bleed back of the treating solution to the scalp and hair not to be treated.

A still further desirable object of the invention is to provide a hairdressing cap puncturable for drawing out strands of hair for treatment including means to facilitate the locating of the area where puncture can be made.

Another desirable object of the present invention is to provide a hairdressing cap of the foregoing desirable objects which is simple and economical to construct.

These and other desirable objects of the invention will in part appear hereinafter and will in part become apparent after consideration of the specification with reference to the accompanying drawings.

SUMMARY OF THE INVENTION

The present invention discloses a new and improved device for selectively treating strands of hair with a treating solution. The device is formed of a fluid impervious flexible sheet material in the shape of a cap to conform to the head of a person in a generally overlying relationship to the hair thereof and having an inner surface and an outer surface. A plurality of air cells are disposed in spaced relationship about the outer surface of the sheet material forming the cap. The air cells are formed of a generally dome-shaped flexible wall member and have a base wall integral with the sheet material. The air cells are puncturable to form perforations permitting strands of hair to be pulled therethrough for treatment with the treating solution. The punctured air cell walls form a positive air-pocket seal around the strands of hair thereby preventing the penetration of the treating solution to the scalp and hair below the sheet material.

BRIEF DESCRIPTION OF THE DRAWINGS

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENTS

Figure 1:
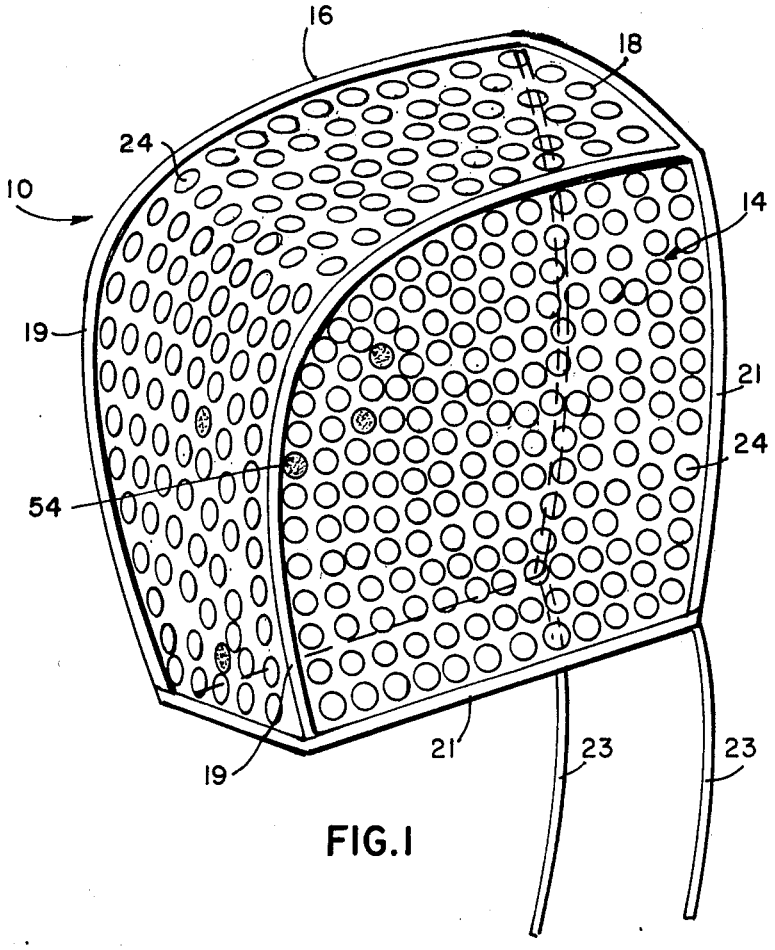
FIG. 1 is a perspective view of a protective hairdressing device in accordance with the present invention.
Figure 2:
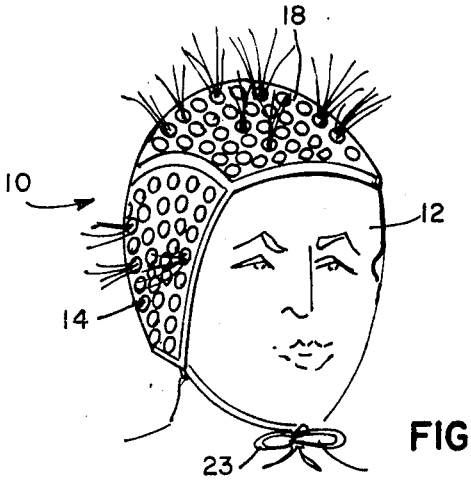
FIG. 2 is a perspective view of a protective hairdressing device in position on a person's head with strands of hair drawn through punctured air cells.

Referring now to the drawings and more particularly to FIGS. 1 and 2, there is illustrated a protective device for selectively treating strands of hair in the form of a hairdressing cap generally at 10, contoured to fit the head 12 of a person employing the invention. The protective device or cap 10 is preferably constructed of three sections or panels comprising side panels 14 and 16 (only 14 being visible) and center panel 18. The sections or panels are preferably constructed of plastic material which is preferably transparent, pliable and flexible, and tear resistant. Suitable plastic materials for constructing the protective device are for example, vinyls, polyethylene, polystyrene and other synthetic resins. The panels or sections may be adhered together by sewing or by heat sealing in order to secure the various sections together at seams 19. The cap 10 may be provided with reinforced margin areas 21 along which the material is folded back upon itself, for example, and its portions 23 which all serve to secure the cap to the head as shown in FIG. 2.

Figure 3:
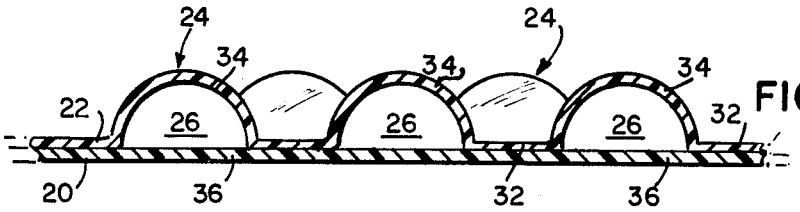
FIG. 3 is a fragramentary cross-sectional view of the protective hairdressing device of the present invention.
Figure 4:
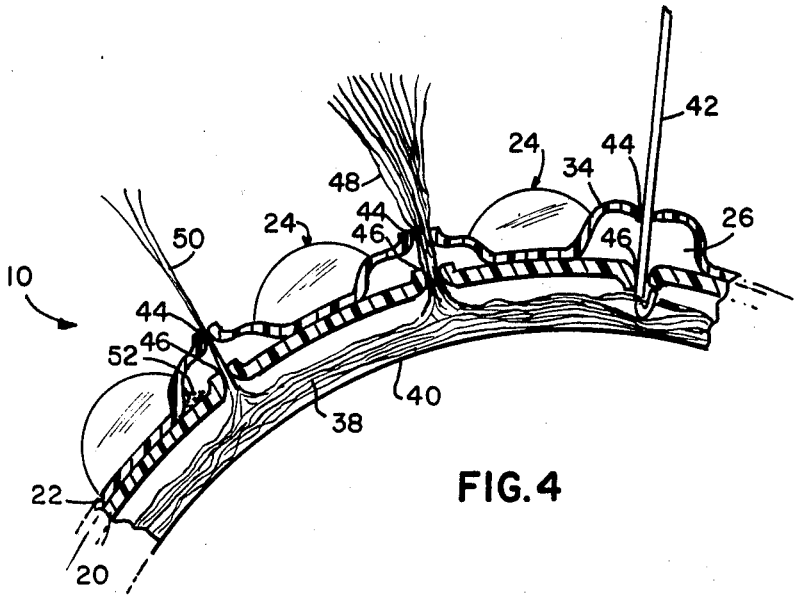
FIG. 4 is a fragmentary cross-sectional view illustrating the use of the protective hairdressing device of the present invention.

As best seen in FIGS. 3 and 4, the several panels of the cap 10 are composed of two plies of flexible sheet material. The two plies or layers comprise an inner sheet member 20 and an outer sheet member 22. In the formed cap 10, the inner sheet member overlies the hair of the person to be treated. The outer sheet material 22 is formed with a plurality of dome-shaped protuberances 24 each of which forms an air cell 26. One suitable method of forming the dome-shaped protuberances is by heating the upper sheet member 22 and then deforming the plastic material to form the plurality of domes 24. The upper sheet member 22 can then be heat sealed to inner sheet member 20 at all areas 32 where the inner sheet member 20 and outer sheet member 22 contact each other. The air cells 26 thus formed comprise an air filled chamber or cell 26, formed of the dome wall portion 34 of upper sheet member 22 and base wall portion 36 of inner sheet member 20. The diameter of the air cell base and the height of the dome can be varied depending upon the number of strands of hair to be treated. Also the number of air cells can be varied depending upon the hair styling desired. For example, for frosting, the air cells 26 can suitably have a dome height of between about 3/16 to 5/16 inch and a base diameter of between about 4/16 to 8/16 inch. The thickness of each of the plastic sheet materials can be varied although a thickness of between about 0.5 to 1.0 mil thickness has been found to be suitable.

The use of the protector device is best explained with particular reference to FIG. 4 showing a portion of the protector device in the form of a cap 10 of FIGS. 1 and 2 applied over the hair 38, the scalp line being represented by line 40. The hair 38 is covered and protected by the cap 10, but the operator may withdraw individual strands by means of tool 42 resembling basically a crochet hook. The tool is used to first perforate the dome wall 34 of the air cell 26 to form a first perforative aperture 44. The perforation of the base wall 36 of the air cell is performed almost instantly following the perforation of the dome wall, to form a second perforation aperture 46. The relative thinness of dome wall 34 and base wall 36 and the positive pressure of the contained air facilitate perforation which can be carried out virtually unnoticed by user.

The tool is then withdrawn whereby the operator withdraws a strand or strands of hair through the perforation apertures 44 and 46. The strand of hair withdrawn may be thick as shown at 48 or thin as shown at 50. The strands 48 and 50 withdrawn through the air cells 26 may then be treated, for example, with a bleaching solution with or without subsequent dyeing, and at the end of the treatment appear as a single thick strand of contrasting color in the wearer's hair. Due to the relative thinness and flexibility of the dome-wall 34 and base wall 36 the aperture walls form a pair of tight seals around each strand of hair. Additionally, the partial pressure of air remaining in the air cells serves to resist the penetration of treating solution into the air cells thereby forming a positive air pocket seal about the strand of hair. As an additional protective feature, should any treating solution pass through the aperture 44, the partially deflated air cell serves as a receptacle or reservoir to contain such treating solution 52 such as shown at the air cell enclosing hair strand 50.

It is believed apparent from the foregoing that the present invention provides a new and improved protective cap for treating selected strands of hair. The air cells facilitate the location of the areas where punctures are to be made whereby the work can be performed satisfactorily by operations of relatively limited skill and experience together with a reduction in operating time. Additionally the cost of the protective device and construction render the protective device of the present invention to be disposable. This is of particular advantage both to the user and the operator. The user is satisfied in that a new and unused protective cap is employed each time. The operator is able to eliminate the time and expense of cleaning the protective cap between uses as required by prior art devices. Additionally, selected air cells can be provided with a plurality of external indicia means 54 (FIG. 1) to describe one or more areas or patterns to receive different treatment, for example, one or more color indicia.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

I claim:

1. A device for selectively treating strands of hair with a treating solution comprising:

a fluid impervious flexible sheet material adapted to conform to the head of a person in generally overlying relationship to the hair thereof and having an inner surface and an outer surface;

said sheet material having a plurality of air cells disposed in spaced relationship about the outer surface of said sheet material;

said air cells being formed of a generally dome-shaped flexible wall and having a base wall integral with said sheet material;

said air cells being puncturable through said dome wall and said base wall to form upper and lower perforations permitting strands of hair to be pulled therethrough for treatment with said treating solution;

said punctured air cell walls forming seal means around said strands of hair, whereby to prevent the penetration of treating solution to the hair below said sheet material.

2. The device of claim 1 wherein the dome-wall and base wall of said air cells are sufficiently pliant whereby the circumferential edges of said upper and lower perforations form a pair of seals about said strands of hair.

3. The device of claim 1 wherein said sheet material is formed of a relatively thin sheet of plastic.

4. The device of claim 1 wherein said punctured air cell forms a chamber to entrap treating solution penetrating said air cell whereby to prevent the further penetration of treating solution to hair below said sheet material.

5. A device for selectively treating strands of hair with a treating solution comprising:

a fluid impervious flexible cap member adapted to conform to the head of a person in generally overlying relationship to the hair thereof;

said cap member being formed of an outer and an inner sheet member of flexible material secured together;

said outer sheet member having a plurality of hollow relatively thin walled protuberances sealed about the periphery thereof to said inner sheet to form a plurality of air cells disposed in spaced relationship about the outer surface of said cap member;

said air cells being puncturable to form upper and lower perforations permitting strands of hair to be pulled therethrough for treatment with said treating solution;

said upper and lower perforations forming a pair of seal means around abutting strands of hair, whereby to prevent the penetration of treating solution to the hair below said sheet material.

6. The device of claim 5 wherein said inner and outer sheet members are formed of relatively thin substantially transparent plastic.

7. In a device for selectively treating strands of hair with a treating solution wherein a fluid impervious flexible transparent sheet material adapted to conform to the head of a person in generally overlying relationship to the hair thereof and having an inner surface and an outer surface is employed to protect the head and hair not to be treated;

the improvement comprising a sheet material having a plurality of air cells disposed in spaced relationship about the outer surface of said sheet material;

said air cells being formed of a generally dome-shaped flexible wall and having a base wall integral with said sheet material;

said air cells being puncturable through said dome wall and said base wall to form upper and lower perforations permitting strands of hair to be pulled therethrough for treatment with said treating solution;

said upper and lower wall perforations forming seal means around said strands of hair, whereby to prevent the penetration of treating solution to the hair below said sheet material.

8. The device of claim 7 wherein the dome-wall and base walls of said air cells are sufficiently pliant whereby the circumferential edges of said upper and lower perforations form a pair of seals about said strands of hair.

9. The device of claim 7 wherein said sheet material is formed of a relatively thin sheet of plastic.

10. The device of claim 7 further comprising indicia means disposed upon the outer surface of certain air cells to form a preselected pattern of hair treatment.

11. The device of claim 7 further comprising other indicia means disposed upon the outer surface of certain air cells in a predetermined pattern for treating strands of hair to achieve a desired treatment intensity.

* * * * *